United States Patent [19]

Hursh et al.

[11] Patent Number: 4,843,844

[45] Date of Patent: Jul. 4, 1989

[54] ANTI-FRICTION TWO-PLY ATHLETIC SOCK

[75] Inventors: David F. Hursh, Lahaska; James B. Johnston, Philadelphia, both of Pa.

[73] Assignee: Foster-Boyd, Inc., Lahaska, Pa.

[21] Appl. No.: 172,949

[22] Filed: Mar. 23, 1988

Related U.S. Application Data

[63] Continuation of Ser. No. 363,124, Mar. 29, 1982.

[51] Int. Cl.[4] ..... D04B 7/04

[52] U.S. Cl. ..... 66/196; 66/202

[58] Field of Search ..... 66/178 R, 170, 185–187, 66/196, 202; 2/239

[56] References Cited

U.S. PATENT DOCUMENTS

| | | | |
|---|---|---|---|
| 709,734 | 9/1902 | Bellis | 66/196 |
| 1,018,134 | 2/1912 | Scott | 66/196 |
| 1,434,941 | 11/1922 | Boyd | 66/178 X |
| 2,144,563 | 1/1939 | Davis | 66/185 |
| 2,714,813 | 8/1955 | Hill | 66/178 |
| 2,746,054 | 5/1956 | Heilbronner | 2/83 |
| 2,879,654 | 3/1959 | Evans | 66/176 |
| 3,107,510 | 10/1963 | Manger | 66/185 |
| 3,113,570 | 12/1963 | Holliday | 128/284 |
| 3,259,915 | 7/1966 | Dison | 2/236 |
| 3,307,379 | 3/1967 | Woolley et al. | 66/178 |
| 3,510,882 | 5/1970 | White | 2/239 |
| 3,796,067 | 3/1974 | East | 66/178 |
| 4,047,400 | 9/1977 | Thorneburg | 66/171 |
| 4,341,096 | 7/1982 | Safrit et al. | 66/196 |

FOREIGN PATENT DOCUMENTS

| | | | |
|---|---|---|---|
| 2454766 | 12/1980 | France | 66/178 |
| 29818 | 12/1946 | Norway | 64/178 |

OTHER PUBLICATIONS

Wignall, "Hosiery Technology," Natural R&D Outerwear Assoc., 1968, N.Y., p. 63.

*Primary Examiner*—Ronald Feldbaum
*Attorney, Agent, or Firm*—Paul & Paul

[57] ABSTRACT

A knit sock, especially for jogging or other athletic activity, has a foot portion which includes an inner ply having a first inner surface formed to make relatively high frictional contact with the skin of the wearer and a second, outer surface having relatively low frictional characteristics. The inner ply is inserted within and fixed to an outer ply which includes a first inner surface having relatively low frictional characteristics disposed adjacent said second surface of said first ply and a second, outer surface having a relatively high frictional surface adapted to make contact with the interior of a shoe.

11 Claims, 1 Drawing Sheet

ANTI-FRICTION TWO-PLY ATHLETIC SOCK

This application is a continuation-in-part, of application Ser. No. 363,124, filed Mar. 29, 1982.

BACKGROUND OF THE INVENTION

A. Field of the Invention

This invention relates to socks in general and in particular to a two-ply sock of improved internal antifriction construction for athletic activity such as jogging.

B. Prior Art

Since the advent of the jogging craze, there has been an ever increasing emphasis upon the comfort of the jogger by designing improved shoes and socks which are intended to reduce the physical toll on the feet and legs of the jogger or to increase his foot comfort. Toward this end, various types of sock conceptions have been patented or sold which purport to offer superior comfort, greater foot-ease, greater shock-absorbency, and other advantages.

U.S. Pat. No. 3,250,095 to Bird teaches a single ply sock with inside terry loops of hydrophilic yarn and outside hydrophobic and elastic yarn. The avowed purpose of this construction is to hold or carry perspiration away from the skin of the wearer, but still provide good thermal insulating qualities by providing inside terry loops. Bird asserts that this prevents the yarns from matting or packing down during use which thereby destroys the thermal insulating and softness characteristics of conventional socks.

U.S. Pat. No. 3,796,067 issued to East is a two-ply sock with terry loops on both the inner and outer surfaces for comfort, warmth and durability.

Other double-ply athletic socks are avaialble commercially, but they are bulky and tend to bunch causing abrasion, blisters and other discomfort. Another jogging sock is made of pure silk in two layers, but silk is quite costly, much less durable then synthetic fabrics, and difficult to launder. Also, the low-frictional characteristics of silk permits the inner layer to slide down on the foot of the wearer.

Another sock is made of pima cotton which also is not very durable.

Still other single ply and double ply sock constructions have been marketed for athletic or jogging use, but they have failed to attain the objects that are accomplished by the present invention.

All known commercially available socks for athletic use are not specially constructed to minimize the possibility of blisters. Blisters are caused by the abrasive action caused by the rubbing pressure exerted between the skin of the foot and adjacent sock surfaces. In the act of running, the shoe, sock, and foot are, while the foot is off the ground, in substantially identical forward motion. However, when the shoe strikes the ground, the shoe tends to undergo an abrupt decrease in velocity whereas the foot and sock within the shoe tend to continue forward at a rapid speed until the shoe limits the forward motion. Consequently, there is an abrasive action which occurs at the interface of the foot and sock and at the interface of the sock and shoe. The abrasion and frictional heat built up at that interface is the main cause of blisters or irritation.

It is therefore among the objects of the present invention to provide:

1. An athletic sock which helps to reduce the occurrence of blisters.

2. An athletic sock which gives the wearer a feeling of great foot ease.

3. An athletic sock in which relative motion between the sock and the foot is reduced.

4. An athletic sock wherein relative movement of the foot within the sock does not produce bunching of the sock material.

SUMMARY OF THE INVENTION

A double-ply sock whose inner ply has one surface formed with high friction characteristics adapted to be placed next to the foot and the other surface formed with low friction characteristics. The outer ply is fixed to the inner ply and has an inner surface formed to have low friction characteristics and an outer surface formed to have high friction characteristics.

DETAILED DESCRIPTION OF THE DRAWINGS

Figure 1:
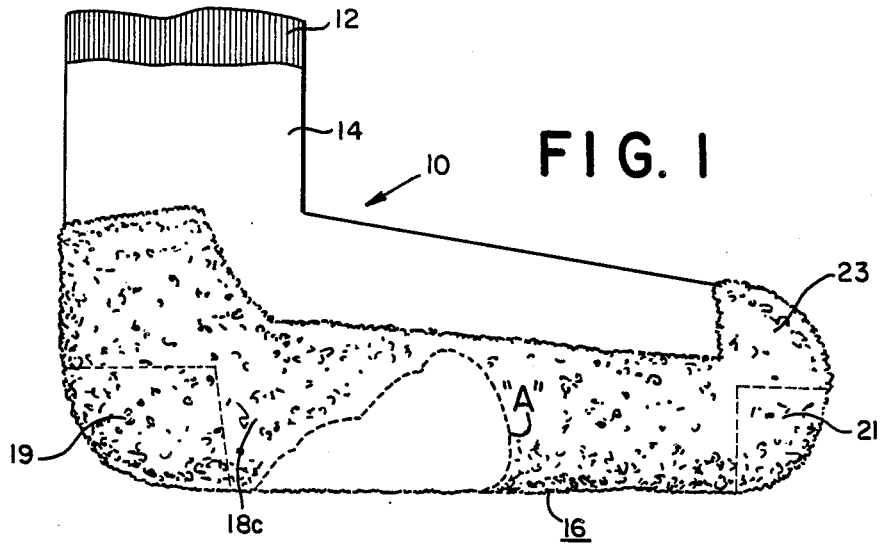
FIG. 1 is a side elevation of the sock in accordance with the present invention.
Figure 2:
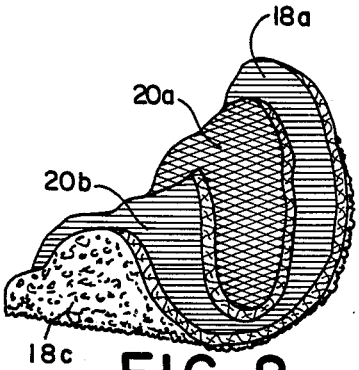
FIG. 2 is an enlarged, fragmentary, partly sectional perspective view of a designated portion "A" of the sock shown in FIG. 1.

FIG. 1 shows a sock in accordance with the present invention which consists of an upper cuff portion 12, a leg portion 14 and a foot portion indicated generally at 16. In one preferred embodiment, it has an outer ply 18 inside of, and to which a slightly smaller inner ply 20 is fixedly disposed as seen in more detail in FIG. 2. The cuff 12 and leg portions 14 are not of primary interest; it is the foot portion 16 which embodies the essence of the present invention.

The inner surface 20*a* of ply 20 is made to have a relatively high friction characteristic so that when the foot of the wearer is placed within it, it will tend to resist movement or slippage of the sock down the leg of the wearer and hence to resist "bunching". The outer surface 20*b* of the inner ply 20 is made to have a smooth, relatively low friction characteristic.

There is also an outer ply 18 whose inner surface 18*a* is also made to have a low friction characteristic so that when it comes into contact with the surface 20*b*, there will be easy sliding movement between those two surfaces. The lower part 18*c* of the outer ply 18 has terry loops so that it will have a relatively high friction characteristic. Thus, when it makes contact with the interior of the shoe, it will resist movement of the outer layer relative thereto. Since the inner layer 20 is in high frictional contact with the foot and the outer layer 18 is in high frictional contact with the interior of the shoe, the outer layer will tend to remain relatively motionless when the foot of the runner comes to a sudden stop as it hits the ground, whereas the inner layer will continue forward and slide on the outer layer lessening the abrasive effects of the inner layer on the skin surface.

The material of the inner play may be a composite fabric whose inner surface is made of 150 denier unworsted wool yarns and whose outer surface consists of a texturized polypropylene yarn plated on the opposite side of the inner surface which possesses the desired low friction characteristics relative to the wool yarn.

The material of the outer ply could be a composite fabric whose outer surface could be cotton and whose inner surface could also be a texturized polypropylene yarn, one material being plated on the other, for example. Terry loops of cotton could be formed in the areas 18c of the sock.

In the manufacture of the sock and, in particular, the choice of yarns for the first and second layers resort may profitbly be had to "Cover Spun" or "Wonder Spun" yarns such as those made and marketed by Leesona and sold by Martin Processing Co. of Martinsburg, Va. These yarns comprise drafted rovings of staple fibers such as cotton, rayon or acrylics, polyesters or blends of them with a spiral wrapping of continuous monofilament or multifilament synthetic fibers such as Nylon 6 or 66, polyester, polypropylene, etc. The inner yarns comprise essentially untwisted parallel fibers bound together by the spiral wrapping.

For the inner layer of the sock, nylon wrapped around cotton or rayon yarns of the "Cover Spun" type may be used which provide low friction characteristics on their outer surfaces yet have good moisture absorption qualities as well. For the outer layer, nylon over acrylic yarns of the "Cover Spun" type may be advantageously employed. Still other variations of "Cover Spun" types of yarns may be chosen according to the various considerations discussed above in connection with the optimum characteristics of the fibers previously discussed.

Although the construction of the leg portion 14 and the cuff portion 12 is not pertinent to the invention, it would be advisable to incorporate elastomeric yarns in both portions to help keep the sock from sliding down since the high friction characteristics of surface 20a may need some assistance in performing that function when the sock is in dynamic use.

In the discussion of the relative frictional characteristics of the various fabrics, reference has been made to "relatively high" and "relatively low". These terms relate to attributes of fabrics which were obtained from tests made on commercially available socks including wool, cotton, silk, nylon, acrylic and polypropylene socks. The socks were tested wet under biaxial stretching with 12% stretch from heel-to-toe and 50% stretch side-to-side in order to simulate the actual use conditions. They were tested on a constant rate of elongation tensile tester in different modes, one of which involved mechanized rubbing the "technical face" (front) of a fabric with controlled pressure against the technical face of another piece of the same fabric. To simulate the rubbing of a fabric against human skin, the technical face of a fabric was rubber under controlled pressure against a rubber surface. To measure other friction characteristics, the technical back was rubbed against the technical back of the same fabric, and also against a rubber surface. Experimental friction forces were determined under these test conditions and normalized by the area of the test surface to produce results ranging from 1.58 g/sq.cm. to 21.1 g/sq.cm. "Relatively high" frictional characteristics in this discussion and in the claims means friction coefficients above about 19 g/cm$^2$ (normalized) as measured in the testing set-up earlier explained. "Relatively low" frictional characteristics is intended to mean those below about 2.5 g/cm$^2$ (normalized).

As mentioned in the example previously given, the surfaces of the plies in contact with one another, if both are made of polypropylene texturized yarns, exhibited the relatively lowest frictional characteristic, i.e., 1.58 g/sq. cm. Cottom, acrylic, wool, silk, and nylon fabrics exhibited friction characteristics ranging from 4.28 g/cm$^2$ to 2.65 g/cm$^2$.

Of course, there are other alternative materials and construction which could effect the same low friction-low friction interface between the inner and outer plies.

As to high frictional characteristics relative to the skin, tests have been performed in which various surfaces of fabrics have been rubbed against rubber. The technical faces of acrylic wool, and polypropylene knitted fabrics have been found by these tests to possess such relatively high friction characteristics. Similar tests against rubber with respect to the technical backs of certain fabrics were done that revealed that acrylics, texturized polypropylene and wool all exhibited similar high frictional characteristics. Silk is equally good except that it is impractical because of price and because of its lesser durability.

In certain instances, to achieve the desired low-friction interface between the two plies, it is possible to use an inner ply made of a plain or jersey knit texturized polypropylene fabric. Its inner surface for positioning next to the skin would be the "technical back" of that fabric whereas its outer surface would be the "technical face" thereof. The outer ply could be made primarily of a texturized polypropylene fabric whose inner surface is its technical face and whose outer surface is its technical back. The face-to-face arrangement of the two plies produces a very low frictional characteristic. If desired, terry loops can be placed at strategic parts of the sole and sides of the foot area. Such a construction is described in the copending application Ser. No. 234,171, of Hursh, Johnston et al, filed Feb. 13, 1981, entitled "Two-Ply Athletic Sock".

MANUFACTURE OF THE SOCK

The sock may be knit upon a circular knitting machine, single cylinder type, such as the "Concept", Model T.S. marketed by Crawford, or the Speizman "Carolina", Model Amy, or the Catawba Valley Machinery Company, Model CVCS fitted with appropriate "stripping" accessories or capabilities. These capabilities allow different yarns to be placed in the exact predetermined positions within the sock so that their qualities may be used optimally.

Figure 3:
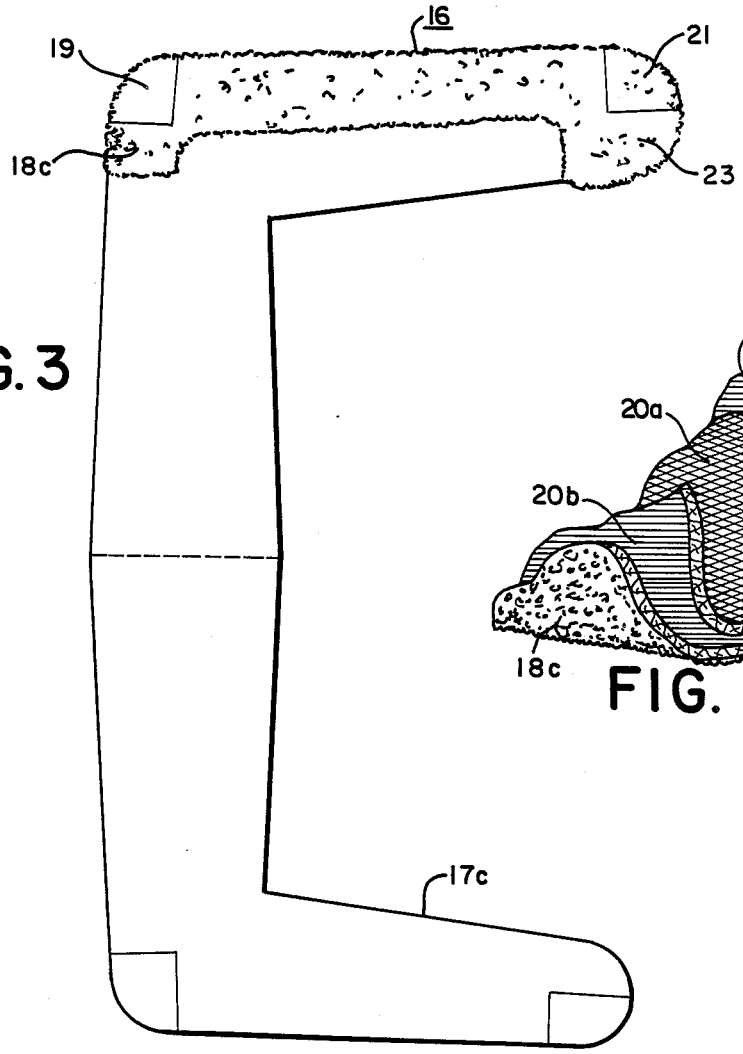
FIG. 3 illustrates one way of making the sock according to the present invention.

As shown in FIG. 3, the sock may initially be knit in the form of a double sock toe-to-toe starting with upper foot portion 16 and continuing to the leg (and cuff portions, if any) and finally to the lower foot portion 17. Heel and toe portions 19 and 21 may be knitted for reinforcement in conventional style. As stated above, the size of the upper sock portion should be slightly larger to facilitate the insertion of the lower one into it for final assembly. For better fit and hence less likelihood of slipping or bunching, the leg-foot relation of each such part should be formed as close to 90° as possible, as this conforms to the natural stance of the foot relative to the leg when exercising.

The sock would come off the knitting machine in one layer and would have openings 16a and 17a in the opposite regions. Closure or attachment of the toe sections to one another should preferably be done in a seamless way, i.e., so that there is no appreciable additional thickness or hard spot in this region that would be a source of irritation to the foot. To achieve this kind of closure, the textile fabrication technique known as "linking" may be employed for joining the toe sections together and closing them, using the same yarns as are incorporated in those areas of the socks. Linking machines of any make could be used, so long as the "linker gauge" is compatible with the gauge of the sock. Either a double-chain over stitch or a single chain stitch could be used. The latter may be advisable as it is simpler and occupies less space.

What is claimed is:

1. A composite sock having at least a foot portion which includes:

(a) an inner ply for being disposed over the foot of a user and having;

(i) a first inner surface adapted to make contact with the skin of the wearer and formed to have a frictional coefficient greater than about 19 $g/cm^2$, and (ii) a second outer surface having a frictional coefficient less than about 2.50 $g/cm^2$, and (b) an outer ply in which said inner ply is disposed, said outer ply having;

(i) a first inner surface disposed adjacent said second surface of said inner ply and which is formed to have a frictional coefficient of about 2.5 $g/cm^2$, (ii) a second outer surface adapted to make contact with the interior of a shoe and formed to have a frictional coefficient greater than about 19 $g/cm^2$ and (c) wherein said second outer surface of said inner ply and said first inner surface of said outer ply comprise means facilitating sliding contact therebetween.

2. The sock according to claim 1 wherein the inner surface of said inner ply is comprised principally of wool yarns.

3. The sock according to claim 1 wherein the inner surface of said inner ply is comprised principally of cotton yarns.

4. The sock according to claim 1 wherein the inner surface of said inner ply is comprised principally of rayon yarns.

5. The sock according to claim 1 wherein the outer surface of said inner ply comprises principally texturized polypropylene yarns.

6. The sock according to claim 1 wherein the inner surface of said outer ply comprises principally texturized polypropylene yarns.

7. The sock according to claim 1 wherein the outer surface of said outer play comprises cotton yarns.

8. The sock according to claim 1 wherein the outer surface of said outer ply comprises rayon yarns.

9. The sock according to claim 1 wherein the outer surface of said outer ply comprises principally wool yarns.

10. The composite sock of claim 1, wherein each of said plies is of knitted fabric construction.

11. The sock of claim 1, wherein said inner ply and said outer ply of at least the area underneath said foot portion are free of stitch or other connections therebetween, whereby the means facilitating sliding contact comprises means that are free of inhibitions of sliding contact in said area.

* * * * *